United States Patent [19]

Dompas

[11] 4,290,823

[45] Sep. 22, 1981

[54] MANUFACTURE OF COPPER WIRE ROD

[75] Inventor: John Dompas, Olen, Belgium

[73] Assignee: Metallurgie Hoboken-Overpelt, Brussels, Belgium

[21] Appl. No.: 88,118

[22] Filed: Oct. 25, 1979

Related U.S. Application Data

[63] Continuation of Ser. No. 516,860, Oct. 22, 1974, abandoned.

[30] Foreign Application Priority Data

Oct. 22, 1973 [BE] Belgium ..... 136901

[51] Int. Cl.[3] ..... C22F 1/08

[52] U.S. Cl. ..... 148/2; 75/76; 148/11.5 C; 164/476

[58] Field of Search ..... 148/2, 11.5 C, 32; 164/76; 75/76, 153

[56] References Cited

U.S. PATENT DOCUMENTS

| | | | |
|---|---|---|---|
| 2,265,284 | 12/1941 | Hulme et al. | 75/76 |
| 3,199,977 | 8/1965 | Phillips et al. | 75/76 |
| 3,589,430 | 6/1971 | Barrow et al. | 164/76 |
| 3,716,423 | 2/1973 | Cofer | 148/32 |

FOREIGN PATENT DOCUMENTS

| | | | |
|---|---|---|---|
| 790182 | 4/1973 | Belgium | 148/2 |
| 798796 | 8/1973 | Belgium | 148/2 |
| 63808 | 3/1973 | Luxembourg | 148/2 |

*Primary Examiner*—Peter K. Skiff
*Attorney, Agent, or Firm*—Fred Philpitt

[57] ABSTRACT

A process for the continuous manufacture of copper wire rod presenting both the good ductility of oxygen-free copper and the annealing capacity of the tough pitch copper, in which liquid copper is prepared containing from about 0.006 to 0.0095% by weight of oxygen, the said liquid copper is cast via an open pouring spout in a continuous casting machine having an inclined straight molding cavity for producing a continuous copper bar containing 0.01 to 0.02% by weight of oxygen and which consists of a shell of solid copper and a core of liquid copper, the said bar on leaving the casting machine is cooled by repeated and direct contact with a cooling agent for complete solidification and the solidified bar is guided towards a horizontal rolling mill known "per se" along a curved path the maximum curvature of which is less than 0.25 $m^{-1}$, and the said bar is rolled into wire rod.

2 Claims, 2 Drawing Figures

FIG. 1.
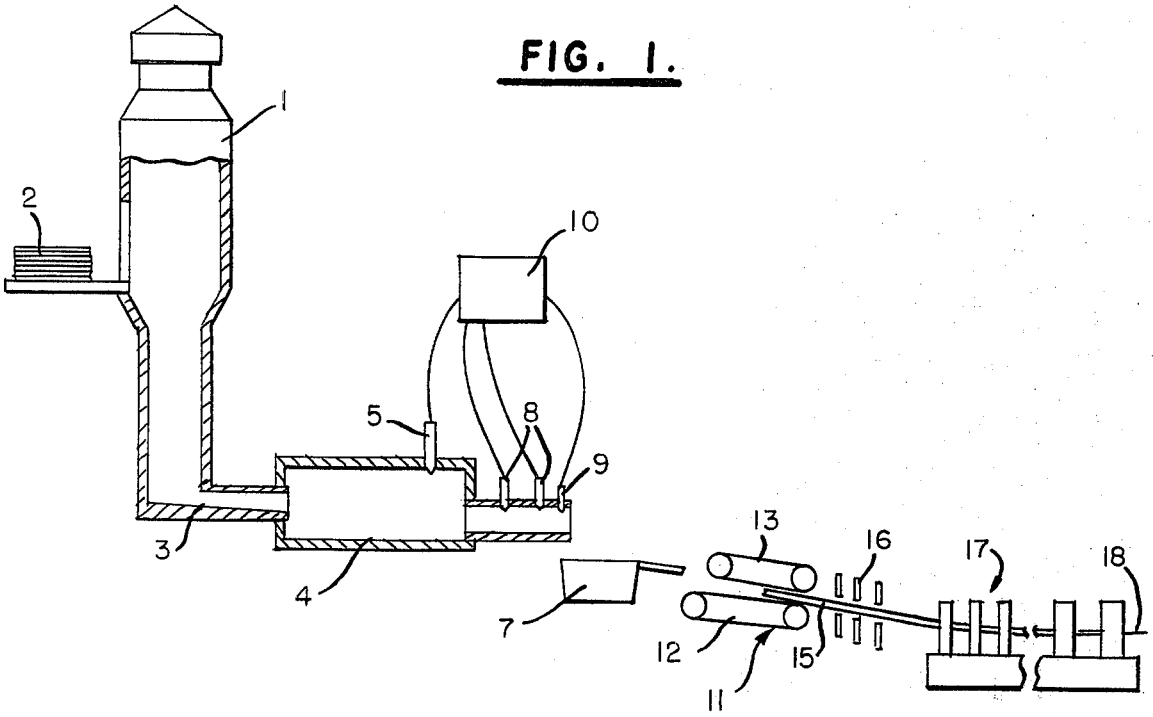
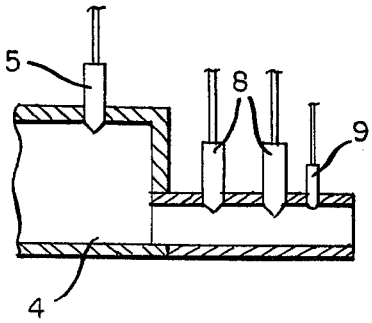
FIG. 2.

MANUFACTURE OF COPPER WIRE ROD

This is a continuation of application Ser. No. 516,860, filed Oct. 22, 1974, abandoned.

This invention relates to an improved process for the continuous manufacture of copper wire rod, in which a continuous copper bar is produced by continuous casting and the said copper bar is guided towards a rolling mill where it is converted into wire rod.

By "wire rod" it is meant a hot rolled wire with a diameter comprised between about 6 and 10 mm, used as starting material in wire-drawing mills.

In the known processes for the continous manufacture of copper wire rod, rod is produced which consists of so-called "tough pitch" copper, i.e. electrolytic copper with an oxygen content which may vary between 0.02 to 0.05% by weight.

"Tough pitch" copper is less ductile than oxygen-free copper because the particles of cuprous oxide have lower mechanical properties than copper. Oxygen-free copper can be wire-drawn more readily, with a larger reduction per pass and to a smaller diameter than "tough pitch" copper.

It has therefore been recently proposed to produce oxygen-free copper wire rod. This is however an expensive operation. Moreover, the annealing temperature of oxygen-free copper is higher than that of "tough pitch" copper, which complicates particularly its conversion into enamelled wire because in enamelled wire production the annealing and enamelling operations are often combined.

The difference in annealing behaviour between oxygen-free and "tough pitch" copper lies in the fact that impurities in oxygen-free copper are in solution, while in "tough pitch" copper part of the impurities are precipitated in oxide form.

It has now surprisingly been found that copper wire rod containing 0.010 to 0.02% by weight of oxygen, when made according to a process such as described and claimed hereafter, presents both the good ductility of oxygen-free copper and the annealing ability of tough pitch copper.

For a better understanding of the details of the invention reference should be made to Belgian Pat. No. 790 182 and 798 796 filed by the Applicant Company.

The invention consists in a process for the continuous manufacture of copper wire rod, characterized in that liquid copper is prepared containing from 0.006 to 0.0095% by weight of oxygen, said liquid copper is cast via an open pouring spout in a continuous casting machine having an inclined straight moulding cavity for producing a continuous copper bar containing from 0.01 to 0.02% by weight of oxygen and which consists of a shell of solid copper and a core of liquid copper, said bar on leaving the casting machine is cooled by repeated an direct contact with a cooling agent for complete solidification, and the solidified bar is guided towards a horizontal rolling mill known "per se" along a curved path the maximum curvature of which is less than 0.25 $m^{-1}$, and the said bar is rolled into wire rod.

Liquid copper containing from 0.006 to 0.0095% by weight of oxygen may be prepared according to the Applicant Company's Luxemburg Patent No. 63 808 by which the oxygen content of liquid copper leaving a holding furnace and its spout, both provided with burners fed with a combustible and an oxygen containing combustive gas, is continuously measured by electrochemical means, the measured value is automatically compared with a control value, and the difference between the measured value and the said control value is used for automatically regulating the ratio combustible/combustive gas fed into the burners so as to obtain a combustion gas with an oxidation-reduction character which will ensure obtaining liquid copper with an oxygen content corresponding to said control value. It is also possible to compare visually the value measured by electrochemical means with the said control value and to regulate manually the ratio combustible/combustive gas fed into the burners so as to obtain liquid copper with an oxygen content corresponding to the said control value.

In the process according to the invention it is preferable to cast a bar with a cross section larger than 70 times the cross section of the wire rod to be produced in order to ensure a thorough working of the metal during rolling.

It is advantageous to use a moulding cavity having a rectangular cross section the base of which will be preferably larger than 1.5 times the height. The two broad walls of said moulding cavity are advantageously formed by two parallel metallic belts advancing in a manner known "per se" in the same direction as the cast bar and which are intensively cooled with water. It is also advantageous to introduce the liquid copper into the moulding cavity at a temperature lower than 1130° C. and with a flow sufficient to produce a bar at a speed higher than 10 m/minute and to chill the bar leaving the casting machine in at least two "intense cooling" zones, each of these zones being followed by a zone without cooling or by a less intense cooling zone, in order to obtain a substantially fine-grained equiaxial casting structure.

The copper wire rod obtained by the above process is characterized by an oxygen content comprised between 0.01 and 0.02% by weight, an elongation higher than 40% and an SP (Spiral Elongation Test) number higher than 300.

The invention will be better understood by the following description given by way of example only and by the accompanying drawing in which:

FIG. 1 represents a diagrammatical view of the equipment, and

FIG. 2 shows a detail on a larger scale.

Copper cathodes 2 having an oxygen content lower than 0.001% by weight are molten in a vertical furnace 1 known "per se" and heated by a series of gas burners (not illustrated). Through a duct 3, molten copper arrives in an induction-heated holding furnace 4 provided with a conditioning gas burner 5.

The oxygen content of the molten copper leaving the holding furnaces 4 through a duct 6 depends upon the oxygen content of the molten copper entering the holding furnace 4 through a duct 3 and upon the oxidation-reduction character of the combustion gas injected by the conditioning burner 5 into the said furnace 4.

The liquid copper flowing through the duct 6 towards the tundish 7 is conditioned by a series of gas burners 8. The oxygen content of the molten copper leaving the duct 6 depends upon the oxygen content of the copper leaving the furnace 4 and upon the oxidation-reduction character of the combustion gas injected by the burners 8 into the said duct 6.

The oxygen content of the molten copper leaving the duct 6 is continuously measured by a solid electrolyte containing an electrochemical cell 9 sold under the registered trade name "Oxycell". The measured value is compared with a control value of 0.0087% by weight of oxygen inside the regulator 10 where the difference between said two values is used for regulating the ratio combustible/combustive gas fed into burners 5 and 8 so as to obtain combustion gases with an oxidation-reduction character capable of ensuring a production of liquid copper having an oxygen content close to the control value. The oxygen content of the liquid copper arriving in the casting ladle 7 is thus comprised between 0.0060 and 0.0095% by weight.

The heating of the furnace 4 and the conditioning burners 8 are so regulated that the copper in the tundish 7 has a temperature of about 1120° C. The liquid copped is poured via the flat open pouring spout of tundish 7 at the rate of about 35 tons per hour into a continuous casting machine 11. During this operation the oxygen content of the copper is about doubled through oxygen pick-up from the air. The continuous casting machine 11 has a straight moulding cavity 1 formed by two endless metallic belts 13 rotating around drums 14 and by two side dams (not illustrated) which keep the said bands 13 apart. This type of casting machine has long been used for the continuous casting of metallic bands and is well known by specialists in the art.

The moulding cavity 12 has a length of 4 m and a cross section of 55 mm×110 mm (distance between the belts X distance between the side dams).

The copper bar 15, leaving the casting machine 11 at a speed of about 13 meters per minute, consists of a shell of solid copper surrounding a core of liquid copper, the said core representing about 30% of the cross section of the bar. The temperature of the external shell of the bar 15 is at this moment about 1020° C. and that of the liquid core is about 1100° C.

The bar 15 leaving the casting machine 11 is guided straight through three zones of intense cooling 16, wherein the said bar is sprinkled with water; between the intense cooling zones the bar is conveyed in the surrounding atmosphere during which conveyance the temperature inside the bar is homogenized since the intensely cooled external shell is not warmed up again by the heat from the core which is still very hot.

The cast bar 15, the cross section of which is now entirely at a temperature of about 890° C. and which has a substantially finegrained equiaxial casting structure, is now guided via trimming and/or cleaning devices known "per se" and not illustrated, towards the horizontal rolling mill 17 along a slightly curved path with a maximum curvature of 0.09 $m^{-1}$ (the maximum curvature of a curve is the inverse of the radius of the most curved part of said curve).

In the rolling mill 17, which is of a conventional type with 15 stands, the cast bar 15 is converted at ±850° C. into a wire rod 18 having a diameter of 8 mm.

The wire rod so obtained has an oxygen content of 0.017% in weight, an elongation of 45.6% and an SP ("Spiral Elongation Test") number of 340. This number was obtained after an intermediate annealing of the wire rod at 850° C. during 30 minutes and after wire-drawing to 1 mm diameter followed by a final annealing at 200° C. in a silicone bath for 2 hours. The SP test was made under a load of 660 g/$mm^2$.

Under the same conditions the wire rod of the prior art made of tough pitch copper had an SP number of 330, while the wire rod of the prior art made of oxygen-free copper had an SP number of 275.

The ductility was thoroughly studied by torsion test after wire-drawing to 1.5 and 1 mm, i.e. after a reduction by cold drawing of respectively 97 and 98.4%.

In the first case the wire of the invention supported 300 torsions before rupture, a wire of the prior art in oxygen-free copper supported 295 torsions and a wire of the prior art in tough pitch copper 220.

In the second case 330 torsions were observed for the wire of the invention, 335 for the wire in oxygen-free copper and 250 for the wire in tough pitch copper.

The above SP and torsion tests were made on coppers presenting the same chemical analyses with exception of the oxygen content.

The wire rod obtained by the process according in the present invention presents thus both the good ductility (number of torsions before rupture) of oxygen-free copper and the annealing ability (SP number) of tough pitch copper.

It is believed, without intending to advance any theory to explain this unexpected result, that it is due to the finely dispersed state of the oxides in the wire rod of the invention which in turn is caused by the low oxygen content, that the equiaxial casting structure of the bar and the thorough working of the latter during rolling are obtained.

What we claim is:

1. A method for the continuous production of copper wire rod comprising:

(a) melting copper cathodes to thereby establish a supply of liquid copper containing from 0.006 to 0.0095% by weight of oxygen, (b) introducing said liquid copper into a holding zone wherein the liquid copper is heated by direct contact with hot combustion gases, (c) continuously analyzing the oxygen content of the molten copper in the holding zone by means of electrochemical means, (d) automatically regulating the ratio of combustible gas to oxygen fed to the burners associated with said holding zone in accordance with the continuous analysis set forth in step (c) so that the oxygen content of the liquid copper in the holding zone will be maintained within the range of 0.006 to 0.0095% by weight of oxygen, (e) passing the liquid copper from said holding zone to a casting ladle, and then introducing liquid copper from said casting ladle, at a temperature of less than 1130° C. and having between 0.006 and 0.0095% by weight of oxygen, into a continuous casting machine having an inclined straight molding cavity formed by two endless metallic belts and two side dams, said molding cavity having a rectangular cross section in which the base of the rectangle is larger than 1.5 times the height of the rectangle, (f) removing from said casting machine a continuous copper bar that has an oxygen content that is twice as much due to oxygen pick-up from the air during the passage of the copper from the casting ladle to the continuous casting machine, said copper bar comprising a shell of solid copper and a core of liquid copper, (g) cooling the copper bar after removal from said casting machine by repeated and direct contact with a cooling agent so as to completely solidify the copper bar, (h) passing the solidified copper bar from step (g) through a horizontal rolling mill along a curved path having a maximum curvature of less than 0.25 $m^{-1}$, and (i) recovering a wire rod having good ductility, an elongation higher than 40%, an SP number higher than 300, and the annealing capacity of tough pitch copper, the cross section of said wire rod being less than 1/70th the cross section of the cross section of the copper bar removed from step (e).

2. A method for the continuous production of copper wire rod comprising:

(a) melting copper cathodes to thereby establish a supply of liquid copper containing from 0.006 to 0.0095% by weight of oxygen, (b) introducing said liquid copper into a holding zone wherein the liquid copper is heated by direct contact with hot combustion gases, (c) analyzing the oxygen content of the molten copper in the holding zone, (d) regulating the ratio of combustible gas to oxygen fed to the burners associated with said holding zone so that the oxygen content of the liquid copper in the holding zone will be maintained within the range of 0.006 to 0.0095% by weight of oxygen, (e) introducing liquid copper from said holding zone, having between 0.006 and 0.0095% by weight of oxygen, into a continuous casting machine having an inclined straight molding cavity formed by two endless metallic belts and two side dams, (f) removing from said casting machine a continuous copper bar that has an oxygen content that is twice as much due to oxygen pick-up from the air during the passage of the copper from the casting ladle to the continuous casting machine, said copper bar comprising a shell of solid copper and a core of liquid copper, (g) cooling the copper bar after removal from said casting machine by repeated and direct contact with a cooling agent so as to completely soidify the copper bar, (h) passing the solidified copper bar from step (g) through a horizontal rolling mill along a curved path having a maximum curvature of less than 0.25 $m^{-1}$, and (i) recovering a wire rod having good ductility and the annealing capacity of tough pitch copper.

* * * * *